US006817214B2

(12) United States Patent
Rabinowicz et al.

(10) Patent No.: US 6,817,214 B2
(45) Date of Patent: Nov. 16, 2004

(54) SELECTIVELY FOLDED TWO-PLY BRASSIERE AND BLANK FOR MAKING THE SAME

(75) Inventors: Sigi Rabinowicz, Antwerp (BE); Talya Hanan, Ramat Yishay (IL)

(73) Assignee: Tefron Ltd. (IL)

( * ) Notice: Subject to any disclaimer, the term of this patent is extended or adjusted under 35 U.S.C. 154(b) by 134 days.

(21) Appl. No.: 10/346,622

(22) Filed: Jan. 17, 2003

(65) Prior Publication Data

US 2004/0142629 A1 Jul. 22, 2004

(51) Int. Cl.[7] ..... D04B 1/22; A41C 3/00
(52) U.S. Cl. ..... 66/176; 450/156
(58) Field of Search ..... 450/65, 69, 70, 450/72, 73, 75, 76, 156; 66/171, 176, 177, 153, 172 E, 170

(56) References Cited

U.S. PATENT DOCUMENTS

| | | | | |
|---|---|---|---|---|
| 2,966,785 A | | 1/1961 | Goff et al. | |
| 3,537,279 A | | 11/1970 | Epley | |
| 3,772,899 A | | 11/1973 | Novi | |
| 3,789,098 A | | 1/1974 | Cole et al. | |
| 4,375,445 A | | 3/1983 | Cole et al. | |
| 4,531,525 A | | 7/1985 | Richards | |
| 4,767,377 A | | 8/1988 | Falla | |
| 5,479,791 A | * | 1/1996 | Osborne | 66/171 |
| 5,553,468 A | * | 9/1996 | Osborne | 66/171 |
| 5,592,836 A | * | 1/1997 | Schuster et al. | 66/176 |
| 5,946,944 A | * | 9/1999 | Osborne | 66/176 |
| 6,125,664 A | | 10/2000 | Browder, Jr. | |
| 6,178,784 B1 | | 1/2001 | Marley, Jr. | |
| 6,287,168 B1 | | 9/2001 | Rabinowicz | |

FOREIGN PATENT DOCUMENTS

DE 1920125 11/1970

* cited by examiner

*Primary Examiner*—Danny Worrell
(74) *Attorney, Agent, or Firm*—Alston & Bird LLP

(57) ABSTRACT

A brassiere for extending around a wearer's torso and supporting the wearer's breasts. The brassiere includes a torso strap supporting a pair of breast cups which in turn support the wearer's breasts. The breast cups are constructed of a two-ply fabric, preferably a circularly knit fabric, and each of the breast cups has a fold line positioned along at least a portion of its top edge so as to improve wearer comfort and reduce seams visible through clothing. Also, an underwire may be attached to an exterior side of one of the plies of the two-ply material of each of the breast cups to provide extra support. Optionally, the fold may be knit to have a thinner material than the remaining plies to facilitate formation of a smooth folded upper edge of the breast cup with a finished appearance.

35 Claims, 3 Drawing Sheets

SELECTIVELY FOLDED TWO-PLY BRASSIERE AND BLANK FOR MAKING THE SAME

BACKGROUND OF THE INVENTION

1) Field of the Invention

The present invention relates to brassieres. The invention relates more particularly to brassieres including non-underwire and underwire brassieres, and blanks and methods for making such brassieres, wherein the blanks are formed from circularly knit fabric tubes.

2) Description of the Related Art

Brassieres are generally designed to provide support, shaping, and separation of the wearer's breasts. Conventionally, brassieres for larger-breasted women often include underwires extending along the lower margins of the breast cups. Underwires provide a level of stability, or at least the perception of stability, that fabric alone generally cannot provide, in part because fabric cannot support compressive forces the way underwires can. Typically, brassieres are fashioned in a cut-and-sew manner, as exemplified for instance in U.S. Pat. No. 4,372,312. A brassiere made in this manner may consist of more than a dozen separate fabric pieces sewn together. One advantage of the cut-and-sew method is that different areas of the brassiere can be given different properties, since the various fabric pieces can be of different knits, different yarns, etc. It may be advantageous, for example, to make some portions of the brassiere resiliently stretchable to hug the wearer's body, while other portions are relatively unstretchable for greater stability.

The cut-and-sew method, however, is disadvantageous in that it entails a great number of cutting and sewing operations. Accordingly, methods of fashioning brassieres from circularly knit fabrics have been developed in an effort to improve the speed and efficiency of production. For example, commonly assigned U.S. Pat. Nos. 5,479,791 and 5,592,826 disclose methods for making non-underwire brassieres from circularly knit tubular blanks. The brassieres are made from single-ply tubular blanks that have a turned welt at one end to form a torso portion of the brassiere. A series of courses for defining breast cups and front and rear shoulder straps are integrally knit to the turned welt. The brassiere requires sewing only for joining the front and rear shoulder straps to each other. The '826 patent discloses modifying the knit structure along outer edges of the breast cups nearest the wearer's arms to form panels having a greater resistance to coursewise stretching than the remainder of the fabric blank. The relatively unstretchable panels provide increased lift and support.

U.S. Pat. No. 6,287,168 overcomes some of the aforementioned problems by providing a brassiere formed from a circularly knit fabric tube 50, as shown in FIGS. 2 and 3 of the '168 patent. The blank is knit to have two pairs of breast cups 24, torso encircling portions 26 and central panels 28 that are arranged in mirror image about a fold region 56 along which the blank is folded so that the cups, torso encircling portions and central panels overlap and form a two-ply structure. Advantageously, the central panel can be knit to have greater resistance to stretching than the cups and torso encircling portions for an effect similar to cut-and-sew brassieres but without seams for additional wearer comfort. Despite the minimal seams, however, the brassiere still requires the use of elastic banding 46 to secure the edges of the overlapping material together, as shown in FIG. 1 of the '168 patent. Elastic banding has the aesthetic drawback in that it can sometimes show through a blouse. In addition, elastic banding, depending upon its location, can reduce wearer comfort.

Therefore, it would be advantageous to have a brassiere that provides adequate and comfortable support for the wearer while at the same time reducing the use of elastic banding and seams. It would be further advantageous if the brassiere were constructed of a circular knit fabric tube to minimize the amount of cutting and stitching necessary to construct the brassiere.

BRIEF SUMMARY OF THE INVENTION

The present invention addresses the above needs and achieves other advantages by providing a brassiere for extending around a wearer's torso and supporting the wearer's breasts. The brassiere includes a torso strap supporting a pair of breast cups which in turn support the wearer's breasts. The breast cups are constructed of a two-ply fabric, preferably a circularly knit fabric, and each of the breast cups has a fold line positioned along at least a portion of its upper edge so as to improve wearer comfort and eliminate the need for elastic trim along the upper edge and thereby reduce seams visible through clothing. Optionally, the fold may be knit to have a thinner material than the remaining plies to facilitate formation of a crisp fold along the upper edge of the breast cup, which helps the fold lie flat against the wearer's skin and thereby imparts a smooth, finished appearance. Also, an underwire may be attached along a lower edge of each of the breast cups to provide extra support.

In one embodiment, the brassiere of the present invention includes a torso strap and a pair of breast cups. The torso strap has at least one pair of ends. A two-ply fabric material having an inner, body-adjacent layer and an outer layer defines the pair of breast cups. The breast cups are attached adjacently to each other and extend between the ends of the torso strap. Each of the breast cups has a lower edge that when worn extends under a respective one of the wearer's breasts. The lower edge includes a seam extending at least partly therealong. An upper edge of each of the breast cups is configured to extend over at least an upper portion of the respective one of the wearer's breasts. The upper edge is defined by a fold line between the inner and outer layers so as to provide a comfortable fit for the wearer.

In another aspect, the upper edge is configured to extend along a medial portion of the wearer's breast. More particularly, the breast cups are attached at a point between the wearer's breasts and each folded upper edge extends laterally upwards from the attachment point along the medial portions of the wearer's breasts.

The torso strap may also be constructed of a two-ply material and includes at least one edge defined by a fold line between its plies. Preferably, the fold line defines a lower edge of the torso strap. The torso strap may be separated into a pair of lateral panels each having a free end opposite the torso strap's attachment to one of the breast cups. Cooperative fastener members attached to the free ends of the two panels allow the free ends to be releaseably joined so that the torso strap can be secured about the wearer's body.

The two-ply fabric material defining the breast cups may be formed of a circularly knit fabric blank folded upon itself along the fold line defining the upper edge of each of the breast cups. The free edges of the breast cups may have underwires either disposed against an exterior side of one of the plies, or between the plies to provide extra support for the wearer's breasts.

In yet another embodiment, the present invention includes a blank for making a brassiere. The blank includes a first series of courses defining a first pair of breast cup panels and a first torso strap panel. The first series of courses begins at a first end of the fabric structure and progresses toward an opposite, second end of the fabric structure. An end of the first series of courses defines an upper edge of the breast cup panels and a lower edge of the torso strap panel. A second series of courses is knit to the end of the first series of courses, progressing to the second end of the fabric structure. The second series of courses defines a second pair of breast cup panels and a second torso strap panel arranged in mirror image to the corresponding panels of the first series of courses. In this manner, the fabric structure can be folded about a fold line located between the first and second series of courses to create a two-ply structure having the first breast cup panels and the first torso strap panel overlying the second breast cup panels and the second torso strap panel, respectively.

Preferably, the fabric structure is a circularly knit fabric tube, which may have a turned welt at one or each end of the tube. Also, the fold line may have a thinner knit than the rest of the blank so as to facilitate sharp folding so that these edges of a finished brassiere that are formed by the fold will lie flat against the wearer's skin.

The present invention has many advantages. For instance, the smooth upper medial edge on each of the breast cups and the smooth bottom edge of the torso strap minimizes the amount of stitching and or banding needed to form the brassiere. Banding and seams tend to show through clothing, creating unsightly lines, especially when in contact with the clothing, such as on the top edge of a breast cup immediately beneath a blouse or shirt. Avoiding the use of seams and/or banding on the upper edge of the breast cup where a blouse or top generally makes close contact therefore improves the aesthetic appearance of the wearer. In addition, reduction of banding and stitching tends to reduce the effort and cost of constructing the brassiere.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
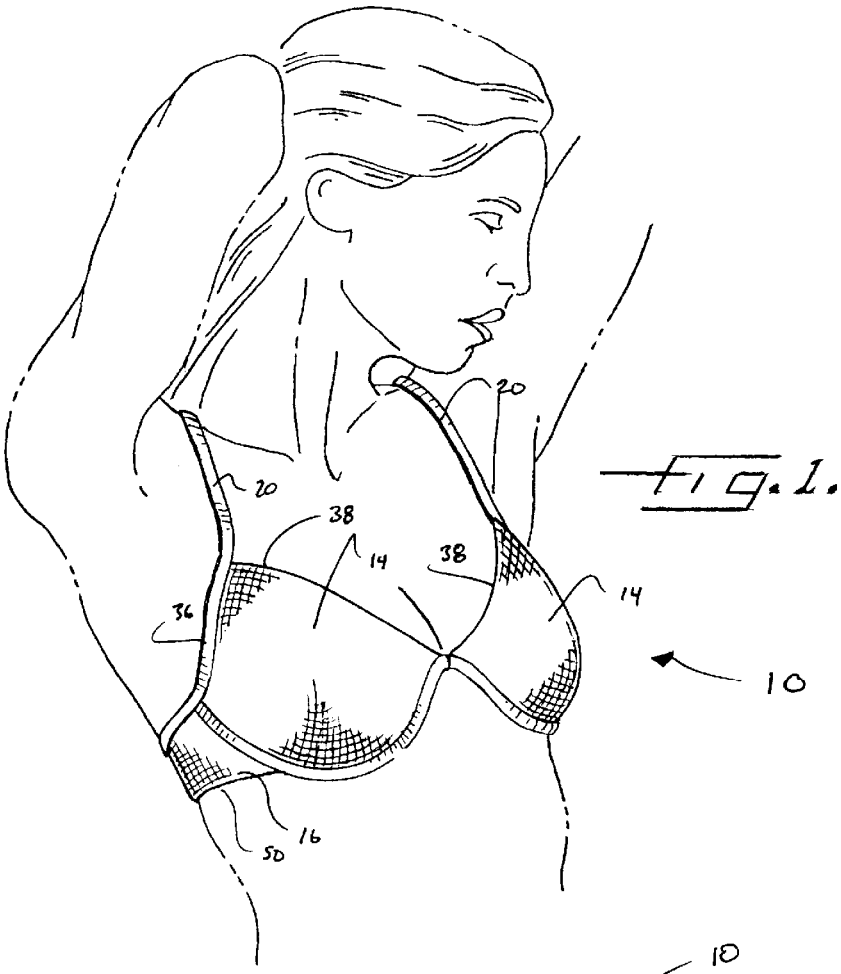
FIG. 1 is a perspective view of a two-ply brassiere of one embodiment of the present invention being worn by a wearer.
Figure 2:
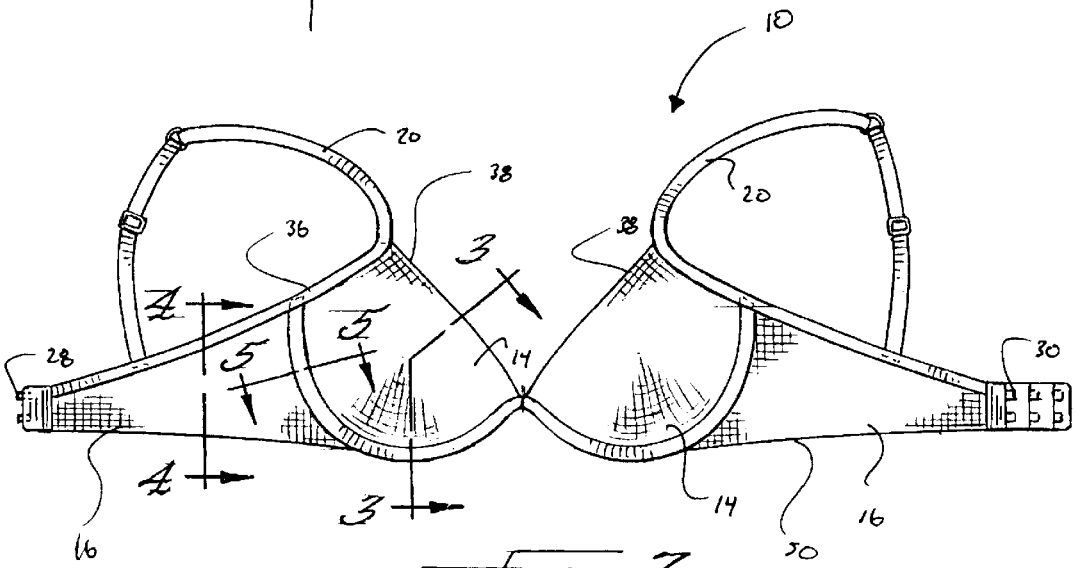
FIG. 2 is a plan view of the brassiere of FIG. 1 laid flat.
Figure 3:
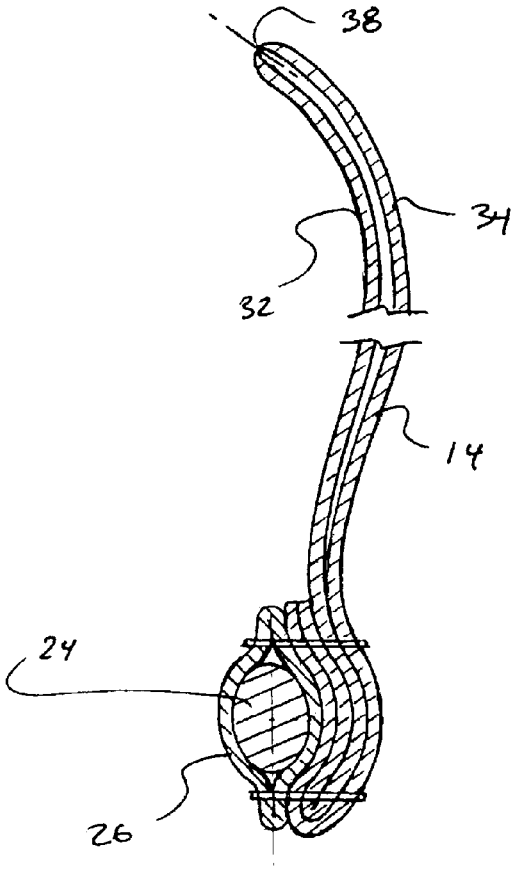
FIGS. 3–5 are sectional views of the brassiere of FIG. 1 along the section lines shown in FIG. 2.
Figure 5:
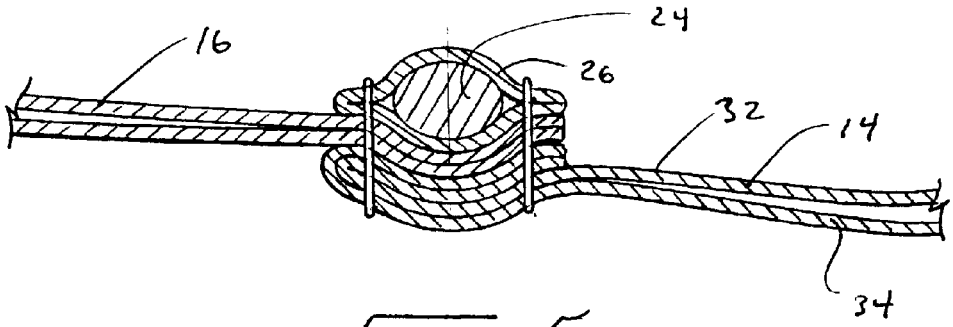

A brassiere 10 of one embodiment of the present invention is shown in FIGS. 1 and 2. The brassiere includes a pair of breast cups 14, a torso strap 16 attached to the breast cups and a pair of shoulder straps 20 attached to the breast cups and the torso strap. The brassiere 10 also includes an underwire 24 sewn to each breast cup for further stability, as shown in FIGS. 2, 3 and 5. Each underwire 24 is encased in a fabric casing 26 and the casing is sewn or otherwise attached to the respective breast cup.

The breast cups 14 and torso strap 16 preferably have a knit structure that makes them resiliently stretchable vertically and horizontally. The breast cups 14 and torso strap 16 can be knit, for example, from various types of face yarns depending on the desired properties of the fabric, and the face yarns can be of various deniers. The selection of the face yarns and the knit depend primarily on the desired characteristics of the fabric such as the hand, appearance, texture, etc. The breast cups 14 and torso strap 16 can also incorporate elastomeric yarns such as spandex (bare and/or covered) or the like so as to impart resiliency to the fabric.

If desired, portions of the breast cups 14 and torso strap 16 may be knit to achieve greater resistance to stretching, as described in commonly assigned U.S. Pat. No. 6,287,168 which is incorporated herein by reference. For instance, some parts of the breast cups 14 and torso strap 16 may be knit from different yarns or can have a different configuration of stitch loops than the other parts.

The torso strap 16 in the illustrated embodiment is formed in two halves comprising one lateral panel having one end attached to one of the breast cups 14 and another lateral panel having one end attached to the other breast cup. The free end of one of the halves of the torso strap has fastener members 28, such as hooks, attached to it. The free end of the other half of the torso strap has cooperative fastener members 30, such as eyes, attached to it for engagement with the opposite fastener members 28 so that the brassiere can be engaged about the torso of a wearer.

Figure 4:
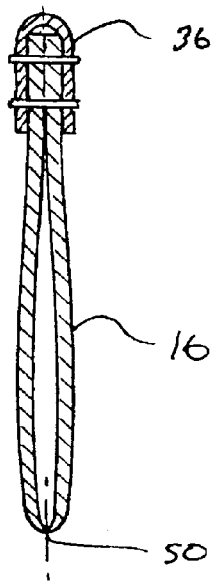

The brassiere 10 preferably has a two-ply construction as best seen in the cross-sectional views of FIGS. 3 through 5. Each of the breast cups 14 and the torso strap 16 are formed from a piece of fabric, preferably cut from a single, continuous piece of circular-knit fabric, folded upon itself to define an inner ply 32 that faces the wearer's body and an outer ply 34 that faces outward. Advantageously, the plies of the breast cups are folded so as to strategically place their edges formed by folding for maximum comfort and to minimize the appearance of seams through outer clothing. For instance, as can be seen in the illustrated embodiment, a fold line of the plies of each of the breast cups 14 is positioned so as to form a bandless upper, medial edge 38. A fold line of the torso encircling strap 16 is on the bottom of the torso encircling strap so as to form a bandless bottom edge 50. The orientation and size of the smooth upper edge of the breast cups 14 can be changed to suit the style or type of the brassiere and still be within the scope of the present invention. For instance, a lateral portion of the upper edge may be smooth and seamless.

The lower, free ends of the plies of each of the breast cups 14 are folded over (forming a four-ply region for a smooth edge) and stitched together with the same stitching used to secure the fabric casing 26 enclosing the underwire 24 to the breast cups, as shown by the sectional view in FIG. 3. In non-underwire brassieres, the free edges of the breast cups can be secured by stitching, ultrasonically welding, gluing, or otherwise attaching a strip of elastic or non-elastic banding that is wrapped over the free edges of the breast cups for a finished edge. Also, the underwire can be attached in other configurations, such as by being sealed or stitched between the plies of the breast cups 14, or housed in the fabric casing 26 stitched onto the front of the breast cups.

Medial portions of the free ends of the plies forming the torso encircling strap 16 adjacent the breast cups 14 are also secured to the breast cups by stitching or otherwise attaching the fabric casing 26 and underwire 24 to the breast cups. In particular, the medial portions of the free ends of the torso strap 16 plies are secured between the plies of the breast cups 14 and the casing 26, as shown by the sectional view in FIG. 5. The remainder of the free ends of the plies along the upper edge of the torso strap 16 and the lateral edges of the breast cups 14 are secured together by extending the portions of the shoulder straps 20 thereover. The shoulder straps are preferably formed of a strip of banding 36 folded over on itself and joined together. The banding is also wrapped about the free edges of the plies of the breast cups 14 and torso strap 16 and secured thereto, as shown by the sectional view of FIG. 4.

Figure 6:
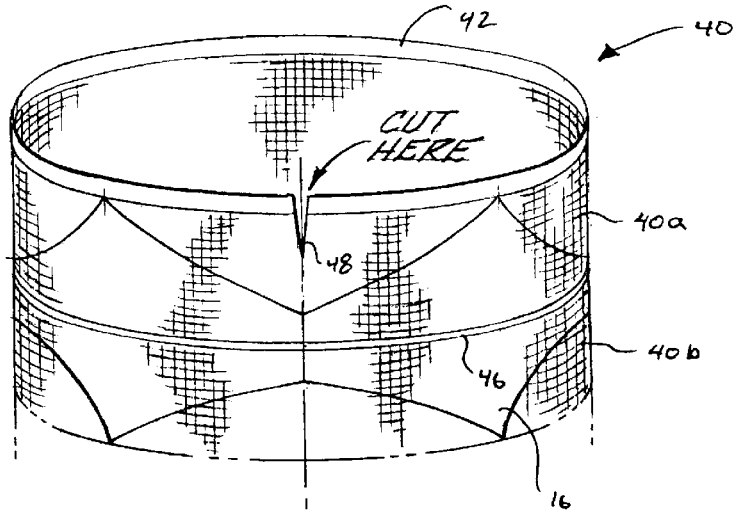
FIG. 6 is a perspective view of a tubular blank defining panels of the brassiere of another embodiment of the present invention.

The brassiere 10 preferably is fabricated from a circularly knit fabric tube 40, as shown in FIG. 6. The tube 40 preferably has a turned welt 42 formed at one end and may have another turned welt (not shown) at the other end to prevent the tube from raveling and to facilitate handling of the fabric in subsequent fabrication processes as described below. Knitting of the tube 40 begins by knitting the turned welt 42. A first series of courses is then knit to the turned welt 42 so as to form a first tubular structure 40*a* defining panels 14 for forming the breast cups and the torso strap 16. The first series of courses terminates at a fold region 46 that will define the lowermost edge of the finished brassiere.

Preferably, the fold region 46 is knit to be thinner than the rest of the fabric tube, which can be accomplished, for example, by dropping the heavier yarns for a few courses (e.g., for about 8 courses) such that only the lighter yarns are knit for those courses. Next, a second series of courses is knit to the end of the first series of courses so as to form a second tubular structure 40*b* forming an extension of the first tubular structure 40*a*. The second tubular structure 40*b* defines breast cup panels 14 and torso strap panel 16 in mirror image to the corresponding features of the first tubular structure about the fold region 46. At the end of the second series of courses, an optional turned welt can be knit and the fabric tube 40 is taken off the circular knitting machine.

By folding the fabric tube 40 about the fold region 46, the second tubular structure 40*b* can be positioned in overlying relation to the first tubular structure 40*a* so that the breast cup panels and torso strap panels of the two tubular structures are overlying and in registration with each other. If it is desired to fabricate a brassiere having a single continuous torso strap 16 (i.e., such that the wearer dons the brassiere by slipping it over the head and onto the torso), the folded fabric tube 40 can then be cut along sew lines defining the outlines of the breast cup panels 14 and the torso strap panels. In particular, a pair of the overlapping breast cup panels 14 are separated from the other pair of the overlapping breast cup panels and the overlapping torso panels 16 prior to folding and stitching.

The panels are then stitched together into the above-described finished arrangement by rotating the breast cup panels 14 until the fold lines 38 are oriented as the upward medial edges of the breast cups, as shown in FIGS. 1 and 2. The medial portions of the free edges of the plies forming the torso encircling strap 16 are secured to the adjacent portions of free edges of the breast cups 14 by attachment of the underwire 24 and its fabric casing 26, as shown in FIGS. 3 and 5. Attachment of the fabric casing also attaches the breast cups 14 together. The shoulder straps 20 are attached to the remaining free edges of the breast cup panels 14 and the torso panels 16. It should be noted that these steps may be performed in different orders, such as cutting and then folding each of the panels.

Figure 7:
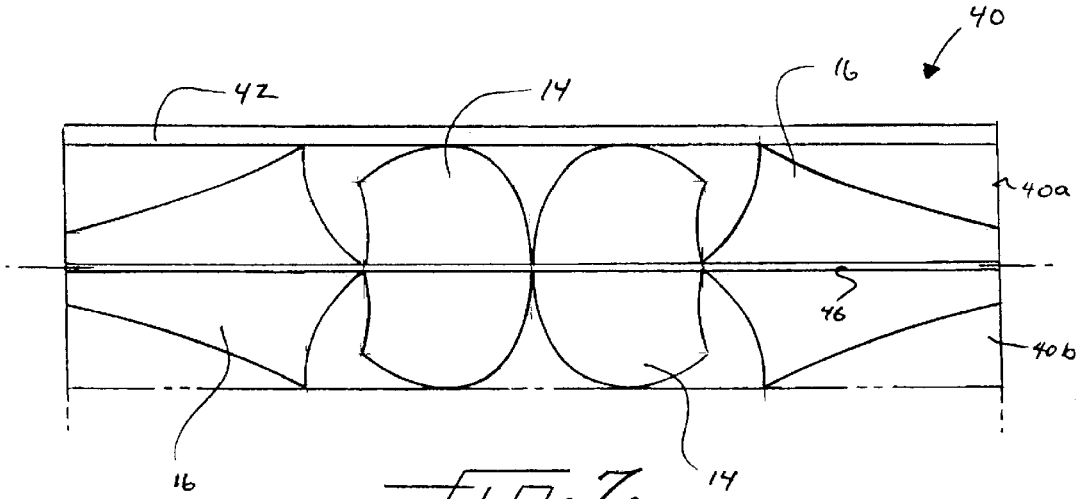
FIG. 7 is a plan view of the tubular blank of FIG. 6 cut longitudinally and laid flat.

Alternatively, the fabric tube 40 can be slit along a longitudinal line 48 located generally diametrically opposite from the breast cup panels 14, as shown in FIG. 6, and the slit tube can be opened up into a flat configuration as depicted in FIG. 7. The resulting flat blank can then folded about the fold region 46, and then the steps of cutting and attaching the underwires and the shoulder straps 30 can be peformed. In this case, the torso strap 26 is formed in two halves and fastener members 28, 30 are attached to the ends of the two halves as with the brassiere 10 of FIG. 2. This fabrication method enables the girth of the torso strap to be reduced from the full girth of the fabric tube 40, if desired.

The flat fabric blank of FIG. 7 can be boarded, if desired, to make it lay flat and to take out wrinkles. The turned welt 42 or welts can facilitate handling the blank during the boarding and other processes, and also prevent the edges of the blank from curling and raveling.

Preferably, the breast cups 14 are molded after the fabric tube 40 is slit and breast cup panels are folded about the fold region 46, so that the breast cups are shaped with a desired contour. To this end, the fabric at least in the breast cup regions includes a heat-settable yarn. Molding can be performed on a conventional molding device, which generally includes a heated convex form and a frame that stretches the fabric over the form so that the heat-settable yarn is softened while in the stretched condition. After softening, the fabric is removed from the form and the heat-settable yarn cools so as to permanently retain the contoured shape of the breast cup. If desired, one two-ply breast cup may be placed over the other two-ply breast cup prior to molding so that both cups are molded simultaneously.

It is also possible to fabricate a blank for the brassiere by circularly knitting a two-ply fabric tube. The tube is essentially knit as one long turned welt by knitting a first series of courses that will become an outer ply of the blank and by knitting a second series of courses that will become the inner ply of the blank. For example, the tube can be knit on a circular knitting machine having cylinder needles and dial needles, the cylinder needles being used to knit the first series of courses and the dial needles being used to knit the second series of courses. The knitting of two-ply tubes is a process known to those of skill in the art, and hence is not further described herein. By knitting the tube as a two-ply structure, the tube does not require turned welts at the ends such as included with the previously described one-ply tube, and the blank comes off the knitting machine as a two-ply structure so as to eliminate the need to fold the blank before cutting.

The present invention has many advantages. For instance, the smooth upper medial edge 38 on each of the breast cups 14 and the smooth bottom edge 50 of the torso strap 16 minimize the amount of stitching and or banding needed to form the brassiere 10. Banding and seams tend to show through clothing, creating unsightly lines, especially when in contact with the clothing, such as on the top edge of a breast cup immediately beneath a blouse or shirt. Avoiding the use of seams and/or banding on the upper edge of the breast cup where a blouse or top generally makes close contact therefore improves the aesthetic appearance of the wearer. In addition, elimination of banding and stitching tends to reduce the effort and cost of constructing the brassiere 10.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A brassiere for extending around a wearer's torso and supporting the wearer's breasts, said brassiere comprising:

a torso strap having at least one pair of ends;

a pair of breast cups each defined by a two-ply fabric material having an inner body-adjacent layer and an outer layer, said breast cups adjacently attached to each other and to the torso strap between the ends of the torso strap, said breast cups each having a lower edge configured to extend under at least a portion of one of the wearer's breasts and an upper edge configured to extend over at least an upper portion of one of the wearer's breasts, wherein the lower edge has a seam formed along at least a portion thereof to attach the layers together and wherein said upper edge is defined by a fold line between the inner and outer layers so as to eliminate banding along said upper edge.

2. A brassiere of claim 1, wherein said folded upper edge is configured to extend along a medial portion of the wearer's breast.

3. A brassiere of claim 1, wherein said breast cups are attached at a point between the wearer's breasts and the folded upper edge extends laterally upwards from the attachment point.

4. A brassiere of claim 1, wherein the torso strap is constructed of a two-ply material and includes at least one edge defined by a fold line between the plies.

5. A brassiere of claim 4, wherein the fold line of the torso strap defines a lower edge of the torso strap.

6. A brassiere of claim 1, wherein the two-ply fabric material is formed of a circularly knit fabric blank folded upon itself along the fold line defining the upper edge of each of the breast cups.

7. A brassiere of claim 1, further comprising underwires attached to the breast cups.

8. A brassiere of claim 7, wherein the underwires are disposed between the plies of the two-ply material.

9. A brassiere of claim 7, wherein the underwires are disposed against an exterior side of one of the plies of the two-ply material.

10. A brassiere of claim 1, wherein the torso strap includes a pair of lateral panels each having an free end opposite the torso strap's attachment to one of the breast cups, the free ends of the lateral panels having cooperative fastener members attached thereto for releasably securing the free ends to each other.

11. A brassiere of claim 1, wherein the upper edge is formed of a portion of the breast cup material having a thickness less than the remaining portion of the breast cup material.

12. A brassiere for extending around a wearer's torso and supporting the wearer's breasts, said brassiere comprising:

a torso strap having at least one pair of ends;

a pair of breast cups each defined by a two-ply fabric material having an inner body-adjacent layer and an outer layer, said breast cups adjacently attached to each other and to the torso strap between the ends of the torso strap, said breast cups each having a lower edge configured to extend under at least a portion of one of the wearer's breasts and an upper edge configured to extend over at least an upper portion of one of the wearer's breasts, wherein said upper edge is defined by a fold line between the inner and outer layers so as to eliminate banding along said upper edge.

13. A brassiere of claim 12, wherein said folded upper edge is configured to extend along a medial portion of the wearer's breast.

14. A brassiere of claim 12, wherein said breast cups are attached at a point between the wearer's breasts and the folded upper edge extends laterally upwards from the attachment point.

15. A brassiere of claim 12, wherein the torso strap is constructed of a two-ply material and includes at least one edge defined by a fold line between the plies.

16. A brassiere of claim 15, wherein the fold line of the torso strap defines a lower edge of the torso strap.

17. A brassiere of claim 12, wherein the two-ply fabric material is formed of a circularly knit fabric blank folded upon itself along the fold line defining the upper edge of each of the breast cups.

18. A brassiere of claim 12, further comprising underwires sewn to the breast cups.

19. A brassiere of claim 18, wherein the underwires are disposed between the plies of the two-ply material.

20. A brassiere of claim 18, wherein the underwires are disposed against an exterior side of one of the plies of the two-ply material.

21. A brassiere of claim 12, wherein the torso strap includes a pair of lateral panels each having an free end opposite the torso strap's attachment to one of the breast cups, the free ends of the lateral panels having cooperative fastener members attached thereto for releasably securing the free ends to each other.

22. A brassiere of claim 12, wherein the upper edge is formed of a portion of the breast cup material having a thickness less than the remaining portion of the breast cup material.

23. A blank for making a brassiere for extending around a wearer's torso and supporting the wearer's breasts, comprising a fabric structure having:

a first series of courses defining first left and right breast cup panels and defining a first torso strap panel, the first series of courses beginning at a first end of the fabric structure and progressing toward an opposite second end of the fabric structure, an end of the first series of courses defining an upper edge of the breast cup panels and a lower edge of the torso strap panel; and a second series of courses knit to the end of the first series of courses and progressing to the second end of the fabric structure, the second series of courses defining second left and right breast cup panels and defining a second torso strap panel arranged in mirror image to corresponding panels of the first series of courses, wherein the fabric structure can be folded about a fold line located between the first and second series of courses to create a two-ply structure having the first left and right breast cup panels and the first torso strap panel overlying the second left and right breast cup panels and the second torso strap panel, respectively.

24. A blank of claim 23, wherein the fold line is thinner than the rest of the blank to facilitate folding.

25. A blank of claim 23, wherein the fabric structure comprises a circularly knit fabric tube.

26. A blank of claim 23, wherein the fabric tube further comprises a turned welt knit at at least one end of the tube.

27. A method for making at least a portion of a brassiere, said method comprising:

knitting a tubular blank by:

circularly knitting a first series of courses to form a first tubular structure including a first pair of breast cup panels and a first torso strap panel defined within the tubular structure; and circularly knitting a second series of courses to an end of the first series of courses to form a second tubular structure as an extension of the first tubular structure, wherein the second tubular structure includes a second pair of breast cup panels and a second torso strap panel wherein the second pair of breast cup panels and the second torso strap panel are shaped similarly to, and positioned in mirror image to, the first pair of breast cup panels and second torso strap panel, respectively, about a juncture between the first and second series of courses;

folding the blank about the juncture between the first and second series of courses such that the first tubular structure overlies the second tubular structure and the panels are in registration with each other so as to form a two-ply blank;

cutting the two-ply blank along cut lines to define a pair of breast cups and a separate torso strap each breast cup having an upper edge defined by a fold line created by folding the blank; and attaching peripheral edges of the two plies of the breast cups and torso strap together.

28. A method of claim 27, further comprising sewing underwires to an exterior side of one of the plies.

29. A method of claim 27, further comprising sewing underwires between the plies.

30. A method of claim 27, wherein stitching includes stitching together at least a portion of a lower peripheral edge of each of the breast cups.

31. A method of claim 27, wherein a plurality of courses are knit at the juncture between the first and second series of courses so as to form a region that is relatively thin compared to the remainder of the blank to facilitate folding the blank at the juncture.

32. A method of claim 27, further comprising slitting the tubular blank along a longitudinal line generally located at a mid-portion of the torso strap and opening up the tubular blank into a flat configuration whereby the torso strap portion is formed into two halves each having one end joined to one of the breast cups and an opposite free end, and further comprising attaching cooperative fastener members to the free ends of the two halves of the torso strap.

33. A method of claim 27, wherein the brassiere is knit with a heat-settable yarn, and further comprising heating and molding the breast cups.

34. A blank for making a brassiere for extending around a wearer's torso and supporting the wearer's breasts, comprising:

a tubular two-ply fabric structure having a first series of courses defining a first tubular fabric ply and a second series of courses knit to one end of the first series of courses so as to define a second tubular fabric ply and wherein the first and second series of courses are separated by a fold line and the fold line defines an upper edge of each of a pair of left and right breast cups defined in the two-ply fabric structure.

35. A blank of claim 34, wherein the two-ply fabric structure comprises a single-ply fabric tube produced on a circular knitting machine and subsequently folded to from the two-ply structure.

* * * * *